United States Patent [19]

Boyle

[11] Patent Number: 4,641,465

[45] Date of Patent: Feb. 10, 1987

[54] POOL CONSTRUCTION AND PANEL SUPPORT MEMBER

[75] Inventor: Michael Boyle, New South Wales, Australia

[73] Assignee: Arabella Limited, Australia

[21] Appl. No.: 706,570

[22] Filed: Feb. 28, 1985

[30] Foreign Application Priority Data

Feb. 29, 1984 [AU] Australia ..... PG3843

[51] Int. Cl.[4] ..... E04G 17/02; E04G 21/00

[52] U.S. Cl. ..... 52/127.1; 52/742; 52/169.7; 52/699; 249/207

[58] Field of Search ..... 52/742, 169.7, 300, 52/698, 699, 127.1, 127.2; 249/2, 7, 10, 13, 83, 207, 213, DIG. 3, 208

[56] References Cited

U.S. PATENT DOCUMENTS

| | | | |
|---|---|---|---|
| 3,031,801 | 5/1962 | Leuthesser | 52/169.7 |
| 3,242,833 | 3/1966 | Sondheim | 249/208 |
| 3,468,088 | 9/1969 | Miller | 52/169.7 |
| 3,776,501 | 12/1973 | Loftin | 249/2 |

*Primary Examiner*—James L. Ridgill, Jr.

*Attorney, Agent, or Firm*—Cushman, Darby & Cushman

[57] ABSTRACT

The specification describes an in-ground concrete pool construction is particularly concerned with the use of a panel support member during the construction.

The panel support member is of elongate form, has a pair of angled surfaces adapted to provide the form for a concrete edge of the pool, and is characterized by a plurality of fixing lugs depending therefrom whereby the panel support member is bolted to the pool wall and a transverse lug at each end thereof is adapted to be joined to a similar support member.

4 Claims, 3 Drawing Figures

15
13
12
16
14
5
9
10
9
1
11

13
15
12
14
15
10
9
4
2
8
5
7
9
10
3
6
1
11
10

POOL CONSTRUCTION AND PANEL SUPPORT MEMBER

BACKGROUND OF THE INVENTION

This invention relates to in-ground pool construction with an overhanging concrete edge and in particular to the use of a panel support member simultaneously during the construction thereof.

SUMMARY OF THE INVENTION

Basically, the panel support member is of elongate form, having a pair of angled surfaces adapted to provide simultaneously the form for an overhanging concrete edge of the pool, characterised by a plurality of fixing lugs depending therefrom whereby they are bolted to the pool wall. Each panel support member also has a transverse lug at each end thereof whereby they are adapted to be joined to a similar support member.

The invention also is broadly concerned with the construction of an in-ground concrete pool in which the top edge of the walls of the pool is formed with a panel support member, said walls being lined with panels to which said panel support member is removably bolted via said depending lugs.

BRIEF DESCRIPTION OF THE DRAWINGS

A better understanding of the invention and its objects and advantages will be gained by referring to the accompanying drawings in which.

DETAILED DESCRIPTION OF THE PREFERRED EMBODIMENT

Figures 1, 2, 3:
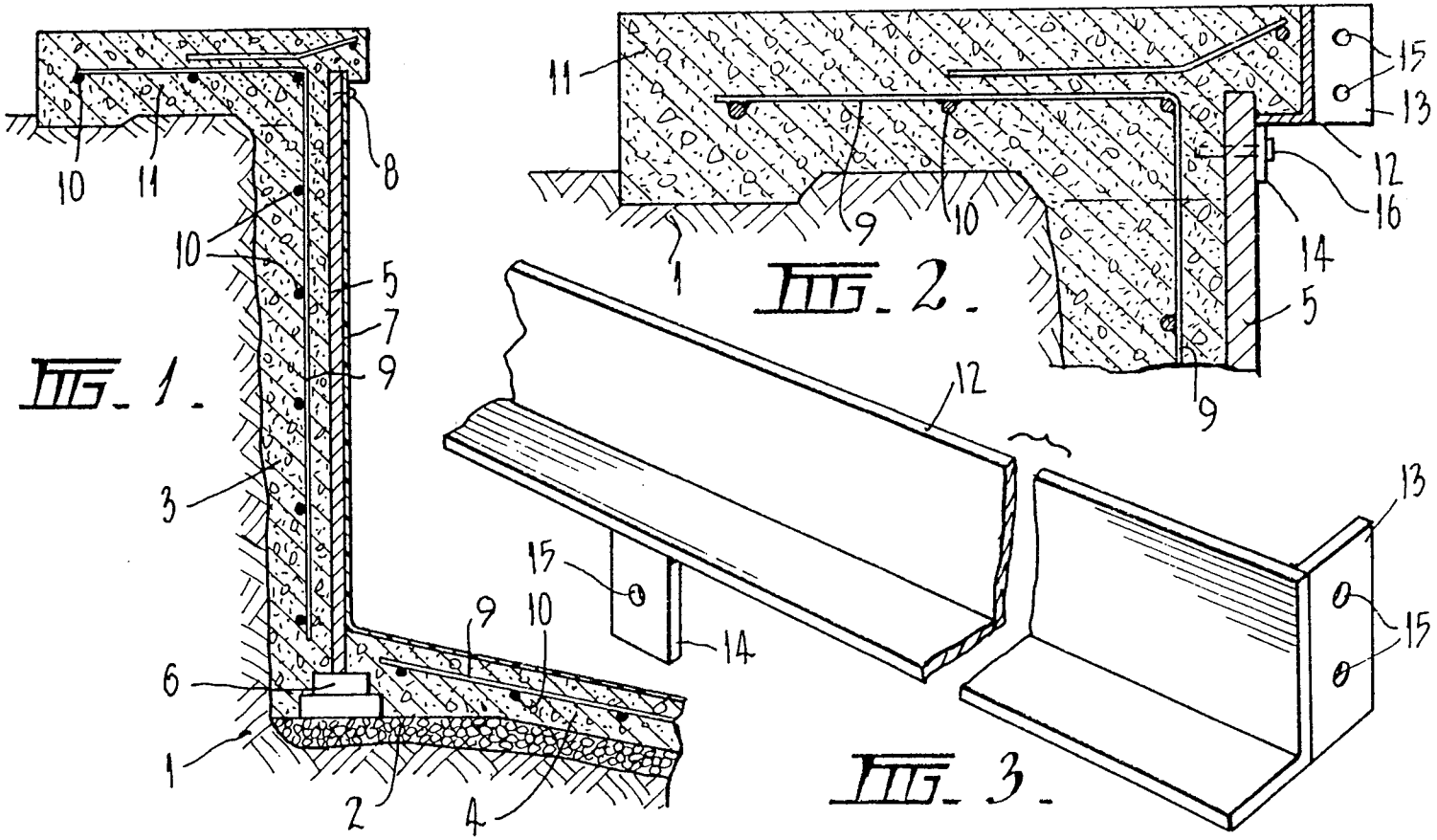
FIG. 1 is a cross-section through a typical concrete in-ground pool construction.
FIG. 2 is a cross-section through the top edge of a concrete in-ground pool construction incorporating the panel support member of the invention.
FIG. 3 is an isometric view of the support panel of the invention.

Referring to FIG. 1, the ground 1 surrounding an excavation is lined (on the floor only) with a gravel bed 2 (e.g. 50 mm thick). The sides of the excavation are lined with concrete walls 3 and the gravel bed 2 is overlaid with a concrete floor 4. The walls 3 are lined with precast fibre steel reinforced concrete panels 5, temporarily supported on concrete blocks 6 during concrete pouring. The blocks 6 become part of the construction. The panels 5 and concrete floor 4 are lined with a waterproof vinyl sheet 7 fixed by a vinyl fixing strip 8 screwed to the panels 5. The concrete walls 3 and floor 4 are reinforced by mesh 9 and rods 10. The panels 5 are, typically, wired together during construction. The surrounding edges of the pool 11 must be formed up before pouring. In FIG. 2, panel 12 is used to form the inward facing edge of the pool edge 11 before pouring the latter. As shown in FIG. 3, the panel support member 12 may be of angle form having a plurality of depending lugs 14 and a transverse lug 13 at each end thereof. The panel support member 12 may be straight or curved or a fancy shape depending on the pool outline. Holes 15 are provided to bolt lugs 13 together to form a perimeter of panel support members 12 about the pool edge 11. Lugs 14 also have holes 15 therethrough whereby such lugs 14 may be secured to the panels 5 by bolts 16 (FIG. 2).

This system using the panel support member 12 provides an integration of the panels and inner edges of the pool edges 11 during pouring of the concrete. An example of the steps of construction is as follows:

(i) Excavate and trim the hole;
(ii) Lay the gravel bed 2;
(iii) Place the mesh and reinforcing rods 10;
(iv) Stand the panels 5, wire them together and fix them in place with the panel support members 12;
(v) Pour the floor 4 and side walls 3, e.g. to half height;
(vi) Finish the pour within 12–24 hours after forming up for the back edge of the pool surround edge 11;
(vii) Fix vinyl liner 7, or if desired, tile the walls 3;
(viii) As the panel support members 12 are removably bolted to the panels 5, they can be removed, preferably before the preceding step.

The use of the removable panel support member 12 of the invention in pool construction simplifies and cheapens the procedure, and provides a more even construction owing to the greater stability provided during the pouring of the concrete.

I claim:

1. A method of constructing an in-ground concrete pool with an overhanging edge comprising the steps of:

excavating a hole to the required size and shape, placing reinforcing material in the hole for a floor and walls of the pool, erecting a plurality of panel members to form a facing for walls of the pool, securing said panel members together and supporting them at their top edges with a plurality of elongate support members, each support member overlapping two or more panel members, fixing said support members by a plurality of dependent lugs to said panel members, securing a transverse lug at each end of said support member to a transverse lug at an adjacent end of an adjacent support member so that the panel members are stabilized and unitized, pouring concrete to form the floor and walls behind said panel members and said support members and also to form said overhanging edge, said edge being formed simultaneously with at least a portion of said walls, allowing said concrete to set, and removing said support members for reuse.

2. The method as defined in claim 1 wherein said panel support members are of angle section with two arms.

3. The method as defined in claim 2, wherein:

depending lugs extend at right angles from an edge of one arm of the angle section of each panel support member in a direction opposite to the extent of the other arm thereof, and a transverse lug extends from an end of said other arm transversely to the extent of both arms and in a direction opposite to the extent of said one arm, and said angle section having respective bores in said depending lugs and said transverse lug for receiving bolts therethrough.

4. A panel support member for use in a method of constructing an overhanging concrete edge and an in-ground concrete pool, said support member comprising:

an angle section with two arms, depending lugs extending at right angles from an edge of one arm of the angle section in a direction opposite to the extent of the other arm thereof, a transverse lug extending from an end of said other arm transversely to the extent of both arms and in a direction opposite to the extent of said one arm, and said angle section having respective bores in said depending lugs and said transverse lug for receiving bolts therethrough.

* * * * *